US005082044A

United States Patent [19]

Christensen

[11] Patent Number: 5,082,044

[45] Date of Patent: Jan. 21, 1992

[54] METHOD AND APPARATUS FOR CONTROLLING THE COMPOSITION OF A MOLTEN METAL BATH

[75] Inventor: Henning J. Christensen, Reading, Mich.

[73] Assignee: Hickman, Williams & Company, Cincinnati, Ohio

[21] Appl. No.: 389,631

[22] Filed: Aug. 4, 1989

[51] Int. Cl.[5] ..... B22D 46/00

[52] U.S. Cl. ..... 164/4.1; 164/150; 164/154; 75/377; 75/384

[58] Field of Search ..... 164/150, 154, 451, 452, 164/4.1; 75/376, 384, 387, 377; 420/590

[56] References Cited

U.S. PATENT DOCUMENTS

| | | | |
|---|---|---|---|
| 4,203,580 | 5/1980 | Buxmann . | |
| 4,248,630 | 2/1981 | Balmuth | 420/590 |
| 4,419,128 | 12/1983 | Nakagawa et al. | 75/384 |
| 4,667,715 | 5/1987 | Knoepke et al. | 164/452 |

FOREIGN PATENT DOCUMENTS

| | | | |
|---|---|---|---|
| 138914 | 12/1978 | Japan | 75/377 |
| 14732 | 3/1982 | Japan | 75/384 |
| 25912 | 2/1984 | Japan | 75/384 |
| 255911 | 12/1985 | Japan | 75/387 |
| 144240 | 7/1986 | Japan | 164/150 |
| 238460 | 10/1986 | Japan | 164/150 |
| 8001810 | 9/1980 | World Int. Prop. O. | 164/4.1 |

*Primary Examiner*—Richard K. Seidel
*Assistant Examiner*—Edward A. Brown
*Attorney, Agent, or Firm*—Harness, Dickey & Pierce

[57] ABSTRACT

An apparatus has means for controlling the composition of a molten metal bath of various elements for providing a consistent molten metal product. The apparatus is automated and the addition of elements to a molten bath is automatically controlled. Also, a method has steps for controlling the composition of the molten metal bath of various elements for providing a consistent molten metal product.

18 Claims, 2 Drawing Sheets

METHOD AND APPARATUS FOR CONTROLLING THE COMPOSITION OF A MOLTEN METAL BATH

BACKGROUND AND SUMMARY OF THE INVENTION

The present invention generally relates to metal casting and, more particularly, to controlling the composition of a molten metal bath to provide consistency of the molten metal for casting.

In the process of making iron, steel scrap and/or cast iron are melted in a cupola and transferred to an induction furnace to provide a molten metal bath. The molten metal within the induction furnace is generally emptied into a transfer ladle which, in turn, is utilized to fill the mold to produce castings.

To produce a molten metal bath having selected percentages of desired elements, such as carbon, silicon or the like, an adjustment of the element levels in the bath is generally required. The adjustment of the element levels is carried out by the addition of elements, such as carbon, silicon or the like, into the bath to produce a molten metallic bath having the desired level or percentage of such elements. The consistency of the chemistry of the molten metal bath is directly related to the uniformity of the castings. As the level of consistency increases, so does the uniformity of the castings.

The quest for consistency is hampered generally by erratic melting of the scrap, due in part to the unknown chemistry of the scrap, erratic alloying practices and the difficulty of adding various elements uniformly over a period of time into the molten bath. Inconsistencies in the molten bath chemistry hampers the production of different grades of metal required in the marketplace.

Due to the size of the induction or holding furnace, it has the capability of maintaining a desired temperature and storing large quantities of molten metal. The large quantities of molten metal cause high and low peaks or concentrations of elements that result from their different melting rates, to be less pronounced. Thus, a more uniform makeup of the metal to be poured may be procured from the induction furnace.

In the past, the required addition of elements into the transfer ladle or induction furnace usually took the form of throwing a shovel or scoop full of an alloy or the like into the molten bath. Thus, an unknown and unprecise amount of alloy or the like was thrown into the transfer ladle or induction furnace in an attempt to provide the desired percentage of elements. Also, alloy additions have been made by gravity feed into a trough between the cupola and the holding furnace. Further, the alloy may be pneumatically injected into the bath in the induction furnace. These methods have generally resulted in erratic and generally poor recoveries.

However, the prior known methods of adding elements into the molten bath generally produce erratic results based on the inaccurate additions. These prior known methods are manpower intensive, expensive and generally produce poor recoveries (e.g. the number of satisfactory castings compared to the total number of castings cast). Other methods for adding elements into molten baths are illustrated in the following U.S. patents: U.S. Pat. No. 4,613,113, issued Sept. 23, 1986 to Saito et al; U.S. Pat. No. 4,581,068, issued Apr. 8, 1986 to Schramm; U.S. Pat. No. 4,525,211, issued June 25, 1985 to Pochmarski et al; U.S. Pat. No. 4,519,587, issued May 28, 1985 to Peckels et al; U.S. Pat. No. 4,518,422, issued May 21, 1985 to Metz; U.S. Pat. No. 4,517,019, issued May 14, 1985 to Taniguchi; U.S. Pat. No. 4,484,731, issued Nov. 27, 1984 to Taniguchi; U.S. Pat. No. 4,414,025, issued Nov. 8, 1983 to Yang; U.S. Pat. No. 4,405,363, issued Sept. 20, 1983 to Tivelius; U.S. Pat. No. 4,398,946, issued Aug. 16, 1983 to Doliwa; U.S. Pat. No. 4,352,605, issued Oct. 5, 1982 to Godding et al; U.S. Pat. No. 4,341,553, issued July 27, 1982 to Immekus; U.S. Pat. No. 4,298,377, issued Nov. 3, 1981 to Szekely; U.S. Pat. No. 4,298,192, issued Nov. 3, 1981 to Barbakadze et al; U.S. Pat. No. 4,286,774, issued Sept. 1, 1981 to Benatar; U.S. Pat. No. 4,277,279, issued July 7, 1981 to Kerlin et al; U.S. Pat. No. 4,264,059, issued Apr. 28, 1981 to Benatar; U.S. Pat. No. 4,180,396, issued Dec. 25, 1979 to Caspers; U.S. Pat. No. 4,180,051, issued Dec. 25, 1979 to Maier et al; and U.S. Pat. No. 4,052,041, issued Oct. 4, 1977 to VonStroh, III.

Improvements have also been made in the field relating to methods of obtaining chemical analysis, thus providing the typical foundry with faster and more accurate chemical analysis. A thermal arrest type of analysis, where temperature plateaus of a cooling sample indicate the levels of various elements within the sample, is used to provide quick and accurate information regarding the carbon equivalent and carbon and silicon content in the bath. This analysis can be performed in close proximity to the melting area thus providing the foundryman with a method of quickly and accurately determining the constituent levels in the molten bath. Although this method is not as complete or as accurate as a spectrometer form of analysis, it is adequate to provide the desired information. These tools enable foundrymen to determine what element additions are necessary to provide the desired chemical makeup in the final metal casting product.

The present invention thus provides the art with a method of accurately controlling the makeup of a molten metal bath thereby enabling a more consistent casting product to be produced. The present invention provides the art with an automated process of adding accurate amounts of elements into the molten bath thereby providing increased control over the elements added, which, in turn provides smaller tolerances or deviations in the makeup of the final casting products.

From the subsequent detailed description, taken in conjunction with the accompanied drawings and subjoined claims, other objects and advantages of the present invention will become apparent to those skilled in the art.

DETAILED DESCRIPTION OF THE PREFERRED EMBODIMENT

Figure 1:
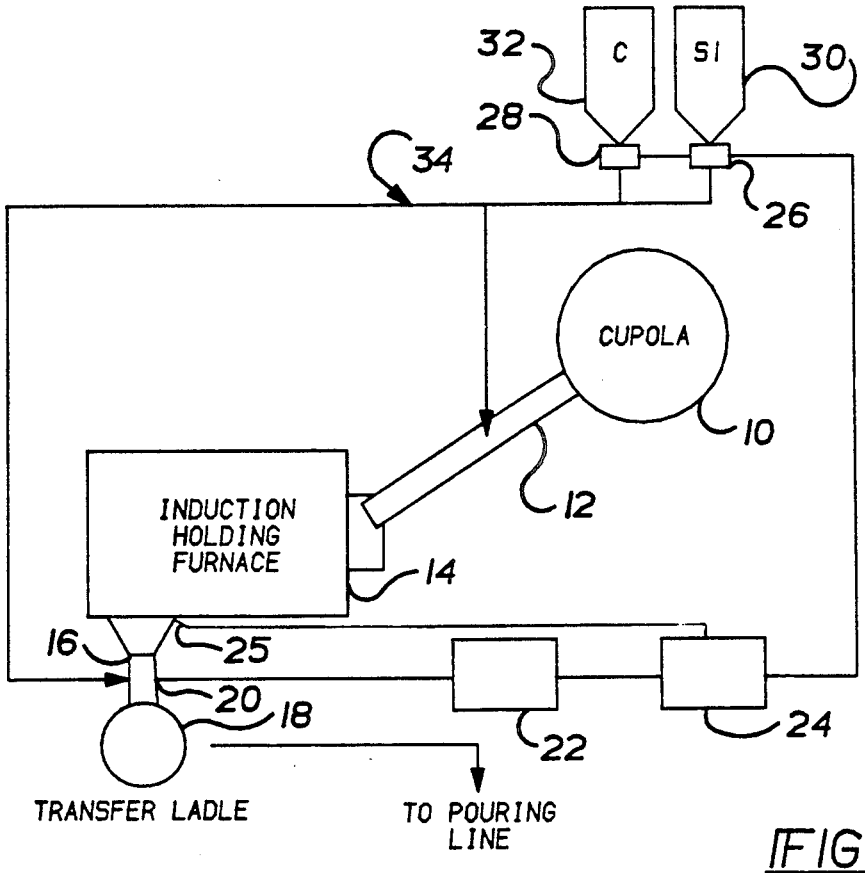
FIG. 1 illustrates a schematic view of an apparatus for accurately controlling the composition of elements in a molten metal bath in accordance with the present invention.

Turning to the figures, particularly FIG. 1, a system for producing a consistent molten metal bath from scrap metal or the like is shown. Generally, the system includes a cupola 10 having a trough 12 feeding molten metal into an induction holding furnace 14. The induction furnace 14 has a spout 16 which enables molten metal to be poured into a transfer ladle 18. The transfer ladle 18 retains molten metal which is to be poured into the castings.

A mechanism 20 for sampling the molten metal bath is positioned to collect a sample of the molten metal between the induction furnace 14 and transfer ladle 18 as the molten iron is discharged from the spout 16 into the transfer ladle 18. A thermo-couple 25 or the like monitors the temperature of the molten bath in the induction furnace 14. The sample is analyzed by an analyzing device 22. The analyzing device 22 is associated with a controller 24 which, in turn, is associated with devices 26 and 28 which enable controlled amounts of elements from bins 30 and 32, containing, for example, but not limited to, carbon and silicon, respectively, to enter into the piping 34 to enable elements to be added into the molten stream at the trough 12 or at the transfer ladle 18.

Generally, steel scrap and/or cast iron are added into the cupola 10 and melted into a hot molten metal liquid. As the scrap metal and/or cast iron melts, the molten material drips to the bottom of the cupola 10, and is transferred to the trough 12. The molten material is gravity fed, via the trough 12, from the cupola 10 into the induction holding furnace 14.

The holding induction furnace 14 generally is sufficiently large to contain an amount of molten metallic material in the range of 20 to 100 tons. This large quantity of molten material tends to diminish the high and low concentrations of elements present in the scrap and/or cast material due to the different melting temperatures or rates of the elements. Thus, the induction holding furnace 14 generally contains molten material having elements present at substantially constant levels.

The molten material is moved from the induction furnace 14, via the spout 16, into a transfer ladle 18. The transfer ladle 18 generally includes a quantity of molten material in the range of 1 to 5 tons. Thus, the transfer ladle 18 readily facilitates pouring the molten material into molds to produce castings or the like.

As the molten material is moved from the induction furnace 14 into the transfer ladle 18, a sampling mechanism 20 samples off a small portion of the molten stream. The sampling may be conducted by manual or automated processes.

A sample from the molten material stream is passed to an analyzer 22. The analyzer 22 may be of the thermal arrest type, spectrometer type or the like. Such thermal arrest analyzers which exist in the field are known under the trade names of Chemlab, Quicklab or Digilab, and various types of spectrometers also exist. Analyzer 22 determines the physical elements present and also the percentage of the elements in the molten material sample. Generally in the case of iron, the analyzer 22 provides information on the amounts of silicon and carbon present in the sample. Also, manganese, chrome or other elements may be monitored or added into the molten material as desired.

The results from the analyzer 22 are interfaced with the controller 24. The controller 24 compares the percentage amounts of the elements present in the sample with predetermined desired percentage amounts of the elements which are to be present in the final product. The controller 24 is programmed with information on the melt rate of the cupola, the size or quantity of the induction furnace, and size or quantity of the transfer ladle 18, and the temperature, via thermo-couple 25, of the molten metal bath. From the comparisons, the controller 24 determines the amount of elements that are necessary to be added to the end product levels.

The controller 24 is coupled with devices 26 and 28 for enabling accurate amounts of elements, such as, but not limited to, silicon and carbon in the case of iron, to be added into the transfer ladle 18. The devices 26 and 28 generally includes a mechanism for weighing the amounts of the element to be added. The proper amount of elements to be added to the transfer ladle are then transferred from the bins 30 and 32 into devices 26 and 28 and into the piping 34 and into the molten stream exiting the spout 16. It should be noted that two bins are illustrated, however, any number of bins could be used to accurately feed or inject into the stream or bath.

In the case the analysis of the sample determines that the percentage of the elements is below a desired preset level, the controller 24 will interface with devices 26 and 28 to enable accurate amounts of specific elements to be intermittently released into the spout 16 and continuously released into the trough 12. The elements are released into the trough 12 and move into the induction furnace 14. This continuous addition of elements would continue for a specified period of time or until the next sample is taken and analyzed to determine if the molten bath is within the preset tolerances.

Figure 2:
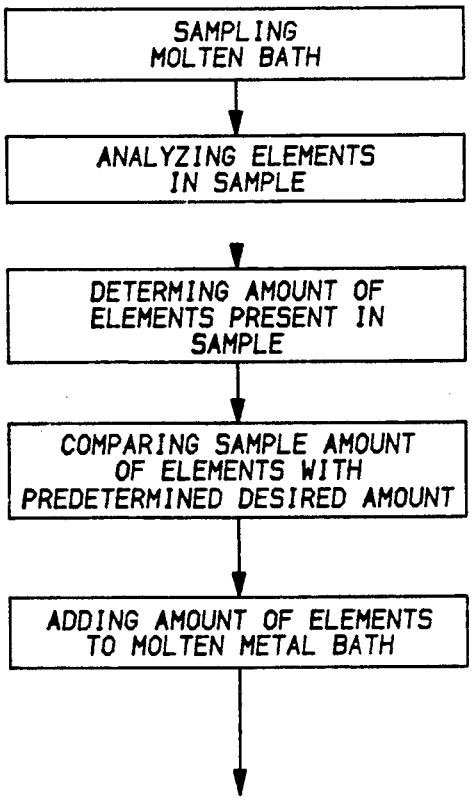
FIG. 2 illustrates a flow chart of a method of accurately controlling the composition of elements in a molten metal bath in accordance with the present invention.

In FIG. 2, a flow chart of a method for controlling the composition of the molten metal bath is illustrated. Generally, the method employs sampling the molten metal bath. The sampling may be conducted by manual or automated processes. After sampling, the sample is analyzed to determine the elements present in the molten bath. Generally in iron baths, the predominant elements present are carbon and silicon. After analyzing the elements present in the bath, a determination of the percentage amounts of each element is made. After determining the amounts of the elements present in the sample, this information is compared with the predetermined amounts of such elements which are desired to be present in the final casting. If the sample is outside the tolerances of the predetermined desired amounts, a specific amount of the elements is added to the molten metal bath to bring the element amounts in the molten metal bath within the desired percentage amounts.

Figure 3:
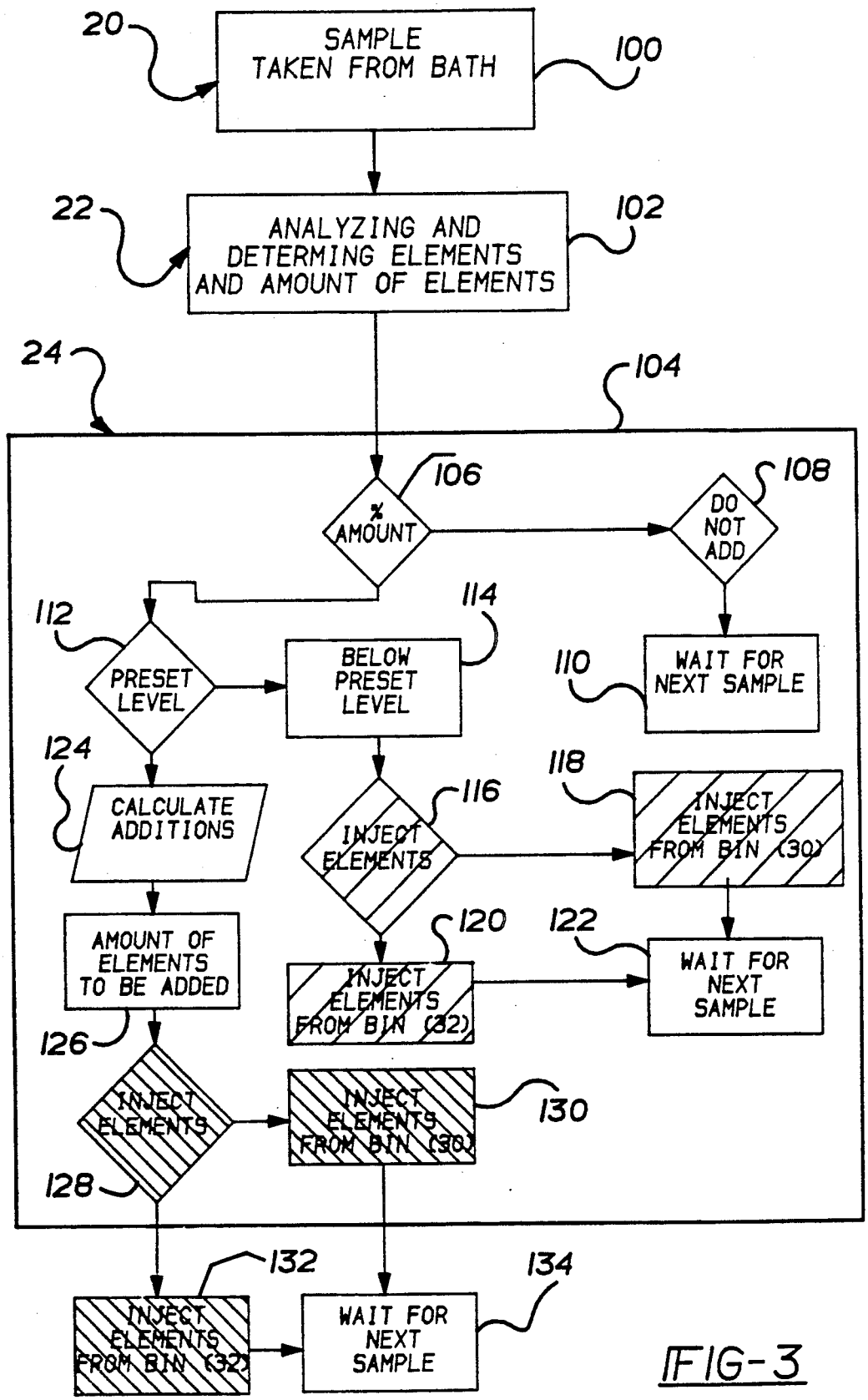
FIG. 3 illustrates another flow chart of the method illustrated in FIG. 2 in accordance with the present invention.

In FIG. 3, a detailed flow chart of the process in accordance with the present invention is shown. The sample is taken at 20 and designated in block 100. In the next step, shown as block 102, the sample is associated with the analyzer 22. The sample is analyzed with respect to the elements present and a determination of the percentage amounts of the elements is calculated. Next, the information from the analyzer 22 is interfaced with controller 24 at block 104.

In the controller 24, a comparison to determine whether or not the percentage value of the amount of elements present in the sample is within the tolerances of a predetermined range is made at block 106. If the percentage range of the elements in the sample is within the predetermined range tolerances, a signal is transmitted at block 108 to the devices 26 and 28 instructing devices 26 and 28 not to release any elements from the bins 30 and 32 since the molten bath is within the desired range. In that instance, the method proceeds to block 110 where the controller 24 waits for the next sample to be taken in block 100.

If at block 106 the range of elements is determined to be outside of the predetermined range, the method proceeds to block 112. At block 112, the controller determines if the percentage value of the elements in the sample is below a low point predetermined level. If the percentage value is below the low point predetermined level, the method proceeds through block 114 to block 116 where the controller transmits a signal to the devices 26 and/or 28 to feed or inject a specific predetermined amount of elements into the molten bath.

Block 116 of the controller determines whether one or both of the elements in bins 30 and 32 should be added into the molten bath. Block 116 then in conjunction with either block 118 or 120, or both, transmits a signal from the controller 24 to the devices 26 and 28 to feed or inject at a predetermined feed rate an amount of elements directly into trough 12. In the case of a molten iron bath, for example, at block 116 the determination is made whether carbon, silicon or both, should be added into the molten bath. If silicon only is to be added, block 116 in conjunction with block 118 would instruct device 26 to meter silicon into the trough 12 through bin 30. If carbon is to be added into the trough 12, block 116 in conjunction with block 120 would instruct device 28 to meter carbon into the trough 12 from bin 32. Also, block 116 in conjunction with both blocks 118 and 120 can transmit appropriate signals to devices 26 and 28 to add both elements. In any case, the addition of elements is made into the trough 12 and the method proceeds to block 122 where the next sample is taken.

If the concentration or percentage amount of the elements is below the high point predetermined level, the method will proceed to block 124, instead of block 114, where the amount of elements to be added into the molten bath will be calculated. After the calculation of the amount of the elements to be added in block 124, the method proceeds to block 126 where a signal is transmitted to devices 26 and 28 to enable injection of the elements to be added into the piping 34. The method then proceeds to block 128 where a determination is made of what elements are to be added from the bins 30 and 32 into the molten bath.

Block 128, in conjunction with block 130 or 132, or both, transmits a signal from the controller to the devices 26 and 28 to inject a predetermined amount of elements directly into the transfer ladle 18. In the case of a molten iron bath, at block 128 the determination is made whether carbon, silicon, or both, should be added into the molten bath. If silicon only is to be added, block 128 in conjunction with block 130 would instruct device 26 to meter silicon into the transfer ladle 18 from bin 30. If carbon is to be added into the transfer ladle 18, block 128 in conjunction with block 132 instructs device 28 to meter carbon into the transfer ladle 18 from bin 32. Also, block 116 in conjunction with both blocks 130 and 132 can transmit appropriate signals to devices 26 and 28 to add both elements. In any case, the addition of elements is made into the ladle 18 and the method proceeds to block 134 where the next sample is taken.

An example of the above system would be as follows.

A cupola is melting at the rate of 50 ton/hour and producing an iron with a desirous carbon specification of 3.40% and a silicon specification of 2.20%. The molten iron exiting the cupola runs down a trough and is held in an induction furnace capable of holding 60 tons of iron at a substantially constant temperature.

A feeding device capable of feeding elements such as carbon and silicon into the stream exiting the holding furnace has been previously setup. Also, a feeding mechanism capable of feeding elements has been previously setup to feed these elements into the cupola trough.

The controller has been preprogrammed so that if the carbon or silicon level falls below the high point preset limit an amount of carbon or silicon or both would be fed into the stream exiting the holding furnace and into the pouring ladle during the next and subsequent pours. The acceptable high point limit and low point limit are set 0.05% apart. In the present case, the high point limits are as stated above and the low point limits are 3.35% for carbon and 2.15% for silicon. If a sample was taken and the carbon and/or silicon percentage level was below the 0.05% predetermined range amount, a second feeder would be initiated in the trough between the cupola and holding furnace. The feed rate of carbon and/or silicon or both into the trough would be proportioned to the melt rate exiting the cupola and would continue to be fed into the trough at a predetermined rate until the next sample is taken. If the next sample is above the low point limit, the predetermined amount of carbon and/or silicon or both being fed into the trough feeder would stop, however, the stream feeders at the ladle would continue to feed the predetermined amount of carbon and/or silicon or both into each pouring ladle full until another sample is taken, at which time new calculations would automatically be made.

For instance, in the case of silicon, a preset desired high point silicon level of 2.20% and a low point silicon level of 2.15% have been programmed into the controller. The holding furnace and cupola are melting and the silicon level in the holding furnace is determined to be 2.22% after a sample is taken. The controller would signal the feeding device not to feed silicon into the stream at the pouring ladle or cupola trough. In the meantime the cupola previously sampled silicon at the 2.22% level now starts to drop. On taking the next sample it is determined that the silicon level is 2.18% or 0.02% below the desired preset level. On tapping the next pouring ladle a predetermined calculated amount of silicon alloy would be fed into the stream entering the pouring ladle. This would continue on each pouring ladle until the next sample was taken.

Upon taking the next sample it is determined that the silicon level has fallen and is now at a 2.14% level or 0.06% below the preset level. It is, also, 0.01% below the second or low point preset level. Immediately the controller will initiate a feed rate of silicon into the trough between the cupola and holding furnace and continue to feed an amount of silicon alloy proportional to the melt rate exiting the cupola. Additionally, the controller will initiate weighing a predetermined amount of silicon to be fed into the stream at the pouring ladle during the next tapping. This will continue until the next sample is taken. The next sample determines that the silicon level as a result of the feeding is now at a 2.18% level. Immediately upon receiving this information the through feeder will stop feeding. The controller will continue estimating an amount of silicon to be added at the pour ladle since the level of silicon is below the desired high point preset level. Subsequent pours will receive this same treatment until the next sample is taken. The results of the next sample determine that the silicon level in the furnace is now at 2.21%, or above the high point preset level. As a result, the next pour ladle will be void of all silicon feeding. No additional feeding would commence until the silicon level in the furnace again falls below the high point preset level of 2.20%.

Carbon and/or other elements could be programmed and fed in a similar manner, through the same controller.

While the above detailed description describes the preferred embodiment of the present invention, it will be understood that the present invention is susceptible to modification, variation and alteration without deviating from the scope and fair meaning of the subjoined claims.

What is claimed is:

1. A method of controlling the composition of a molten metal bath of various metallic elements for providing a consistent molten metal product comprising:

sampling the molten metal bath at a furnace as it passes from the furnace directly to a ladle;

analyzing the elements present in a sample from said molten metal bath;

determining the amount of the elements present in said sample;

comparing the amount of elements present in said sample with a predetermined desirable amount of elements to be present in said product;

adding, if necessary, elements to said molten metal bath either at the furnace; adding, if necessary, elements into said molten metal bath at the ladle;

adjusting, if necessary, the composition of the molten metal bath;

repeating the above steps until the amount of the elements in the sample are within a desired tolerance of the predetermined desired amount of elements to be present in the final product, whereby addition of elements into the molten bath would terminate until the samples fall outside of said tolerance wherein said elements would be added to said bath and said steps repeated and wherein the molten metal in the ladle is poured into castings.

2. The method according to claim 1 wherein said analyzing step further comprises analyzing two or more component elements.

3. The method according to claim wherein said adding step further comprises adding two or more component elements into said molten metal bath.

4. The method according to claim 1 further comprising monitoring the temperature of said molten bath.

5. The method according to claim 1 further comprising weighing the amount of elements added into said molten bath.

6. The method according to claim 1 further comprising adding elements continuously into said molten bath after a first sample is taken if the molten bath is below a desired present limit.

7. The method according to claim 1 wherein said determining step further comprising determining the percent by weight of the elements present in said molten bath.

8. A method for controlling the composition of a molten cast iron bath for providing a consistent cast iron product comprising:

sampling the molten cast iron bath at a furnace as it passes from the furnace directly to a ladle;

analyzing elements of the cast iron present in a sample from said molten cast iron bath;

determining the amount of the elements present in said sample;

comparing the amount of elements present in said sample with predetermined desirable amount of the elements to be present in said product;

adding, if necessary, elements to said molten cast iron bath at the furnace; adding, if necessary, elements into said molten cast iron bath at the ladle;

adjusting, if necessary, the composition of the molten cast iron bath;

repeating the above steps until the amount of the sample elements are within a desired tolerance of the predetermined desired amount of elements, whereby addition of elements into the molten cast iron bath would terminate until the samples fall outside of said tolerance wherein said elements would again be added to said cast iron bath and said steps repeated and wherein the molten cast iron in the ladle is poured into castings.

9. The method according to claim 8 wherein said analyzing step further comprises analyzing silicon and carbon.

10. The method according to claim 8 wherein said adding step further comprises adding silicon and/or carbon into said molten metal bath.

11. The method according to claim 8 further comprising monitoring the temperature of said molten bath.

12. The method according to claim 8 further comprising weighing the amount of silicon or carbon added into said molten bath.

13. The method according to claim 8 further comprising adding silicon and/or carbon continuously into said molten bath after a first sample is taken if the molten bath is below a desired pre-set limit.

14. An apparatus for controlling the composition of elements in a molten metal bath comprising:

means for sampling the elements of the molten metal bath at a furnace as it passes from the furnace directly to a ladle;

means for analyzing the elements present in a sample from said molten metal bath;

means for determining the amount of the elements present in said sample, said determining means associated with said means for analyzing;

means for comparing the amount of elements present in said sample with a predetermined desirable amount of elements to be present in a product, said comparing means associated with said means for determining;

means for adding elements to said molten metal bath for adjusting the composition of the molten metal bath, said adding means associated with said comparing means and operable to add elements at the furnace and add elements at the ladle such that elements may be added to the molten bath at the furnace, ladle or both;

whereby said comparing means repeatedly compares the amount of elements present in the samples with the predetermined desirable amount of elements to be present in the product until the samples are within a desired tolerance of the predetermined desired amount of elements to be present in the product, wherein said adding means terminates the addition of elements into the molten bath until the elements in the samples fall outside of said tolerance wherein said elements would again be added to said bath by said adding means for adjusting the composition of the molten bath and wherein the molten metal in the ladle is poured into castings.

15. A system for producing a consistent molten metal from scrap metal or the like comprising:

means for melting the scrap metal and providing a molten bath of various elements;

means for sampling the elements of the molten metal at a furnace as it passes from the furnace directly to a ladle;

means for analyzing the elements present in a sample from said molten metal bath;

means for determining the amount of the elements present in said sample, said determining means associated with said means for analyzing;

means for comparing the amount of elements present in said sample with a predetermined desirable amount of elements to be present in a product, said comparing means associated with said means for determining;

means for adding elements to said molten metal for adjusting the composition of the molten metal, said adding means associated with said comparing means and operable to add elements at the furnace and add elements to the ladle such that elements may be added to the molten metal at the furnace, ladle or both;

whereby said comparing means repeatedly compares the amount of elements present in the samples with the predetermined desirable amount of elements to be present in a product until the samples are within a desired tolerance of the predetermined desired amount of elements to be present in a product, wherein said adding means terminates the addition of elements into the molten bath until the elements in the samples fall outside of said tolerance wherein said elements would again be added to said bath by said adding means for adjusting the composition of the molten bath and wherein the molten metal in the ladle is poured into castings.

16. The apparatus according to claim 15 further comprising means for sensing the temperature of said sample, said sensing means associated with said comparing means.

17. The apparatus according to claim 15 wherein said comparing means includes a programmable microprocessing means for automatically controlling the amount of elements added to the bath by said adding means, said microprocessing means interfaced with said determining means and adding means.

18. The apparatus according to claim 17 further including means for weighing the amount of elements to be added to said bath.

* * * * *